US006260028B1

(12) United States Patent
Lee et al.

(10) Patent No.: US 6,260,028 B1
(45) **Date of Patent: *Jul. 10, 2001**

(54) TOKEN GENERATION PROCESS IN AN OPEN METERING SYSTEM

(75) Inventors: David K. Lee, Monroe; David W. Riley, Easton; Frederick W. Ryan, Jr., Oxford, all of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/401,012

(22) Filed: Sep. 21, 1999

Related U.S. Application Data

(63) Continuation of application No. 09/062,071, filed on Apr. 17, 1998, now Pat. No. 5,987,441, which is a continuation of application No. 08/575,107, filed on Dec. 19, 1995, now Pat. No. 5,781,438.

(51) Int. Cl.[7] ..... G07B 17/00

(52) U.S. Cl. ..... 705/401; 705/60; 705/62; 705/408

(58) Field of Search ..... 345/435; 101/71; 705/401, 404, 408, 410, 60, 62

(56) References Cited

U.S. PATENT DOCUMENTS

| | | | | |
|---|---|---|---|---|
| 4,377,214 | * | 3/1983 | Hansen et al. | 177/25.15 |
| 4,725,718 | | 2/1988 | Sansone et al. | 235/495 |
| 4,757,537 | | 7/1988 | Edelmann et al. | 380/51 |
| 4,775,246 | | 10/1988 | Edelmann et al. | 380/23 |
| 4,809,185 | | 2/1989 | Talmadge | 364/464.02 |
| 4,813,912 | | 3/1989 | Chickneas et al. | 364/464.02 |
| 4,831,555 | | 5/1989 | Sansone et al. | 364/464.02 X |
| 4,858,138 | | 8/1989 | Talmadge | 364/464.02 |
| 4,873,645 | | 10/1989 | Hunter et al. | 364/479 |
| 4,980,542 | * | 12/1990 | Jackson et al. | 235/375 |
| 5,173,862 | | 12/1992 | Fedirchuk et al. | 364/464.02 |
| 5,177,790 | | 1/1993 | Hazard | 380/28 |
| 5,200,903 | | 4/1993 | Gilham | 364/464.02 |
| 5,325,430 | | 6/1994 | Smyth et al. | 380/4 |

(List continued on next page.)

FOREIGN PATENT DOCUMENTS

0782109 A2 * 7/1997 (EP) .
0908583 A2 * 4/1999 (EP) .

OTHER PUBLICATIONS

Tygar, et al., "Cryptography: It's Not Just for Electronic Mail Naymore" (Mar. 1, 1993), CMU–CS–93–107.

Pastor, Jose, "Cryptopost a Cryptographic Application to Mail Processing," Journal of Cryptography, vol. 3, No. 2, 1991, pp. 137–146.

Pastor, Jose; "Cryptopost A Universal Information Based Franking System for Automated Mail Processing," United States Postal Service Advanced Technology Conference, Nov. 5–7, 1990, vol. 1, pp. 429–442.

*Primary Examiner*—Edward R. Cosimano
(74) *Attorney, Agent, or Firm*—Charles R. Malandra, Jr.; Michael E. Melton

(57) ABSTRACT

A method of issuing digital tokens in a open system meter includes the steps of sending a request for digital tokens and predetermined postal information, including addressee information, from a host processor to a vault that is operatively coupled to the host processor; calculating in the vault in response to the request for tokens at least one digital token using the predetermined postal information; debiting postal funds in the vault; issuing the digital token to the host processor; and storing the digital token and the predetermined postal information as a transaction record in the host processor for subsequent generation and printing of an indicia. The method further includes the steps of generating in the host processor an indicia comprising a graphical image of the digital token and the predetermined postal information and storing the indicia in the host processor; and printing the indicia on a mailpiece when requested.

14 Claims, 6 Drawing Sheets

U.S. PATENT DOCUMENTS

| | | | | |
|---|---|---|---|---|
| 5,363,447 | | 11/1994 | Rager et al. | 380/21 |
| 5,365,466 | | 11/1994 | Hazard | 364/717 |
| 5,384,708 | | 1/1995 | Collins et al. | 364/464 |
| 5,390,251 | * | 2/1995 | Pastor et al. | 705/62 |
| 5,625,694 | * | 4/1997 | Lee et al. | 705/60 |
| 5,655,023 | * | 8/1997 | Cordery et al. | 380/51 |
| 5,717,597 | | 2/1998 | Kara | 364/464.18 |
| 5,742,683 | * | 4/1998 | Lee et al. | 705/60 |
| 5,781,438 | * | 7/1998 | Lee et al. | 705/404 |
| 5,793,867 | * | 8/1998 | Cordery et al. | 705/60 |
| 5,822,738 | * | 10/1998 | Shah et al. | 705/410 |
| 5,822,739 | * | 10/1998 | Kara | 705/410 |
| 5,835,604 | * | 11/1998 | Lee | 380/51 |
| 5,835,689 | * | 11/1998 | Braun et al. | 358/1.14 |
| 5,918,234 | | 6/1999 | Shah et al. | 707/204 |
| 5,930,796 | * | 7/1999 | Pierce et al. | 707/100 |
| 5,987,441 | * | 11/1999 | Lee et al. | 705/401 |

* cited by examiner

TOKEN GENERATION PROCESS IN AN OPEN METERING SYSTEM

The present application is a continuation of U.S. application Ser. No. 09/062,071 (now U.S. Pat. No. 5,987,441), filed Apr. 17, 1998, which is a continuation of U.S. application Ser. No. 08/575,107, filed Dec. 19, 1995, and entitled TOKEN GENERATION PROCESS IN AN OPEN METERING SYSTEM, which issued as U.S. Pat. No. 5,781,438 on Jul. 14, 1998.

FIELD OF THE INVENTION

The present invention relates to advanced postage payment systems and, more particularly, to advanced postage payment systems having pre-computed postage payment information.

RELATED APPLICATIONS

The present application is related to the following U.S. patent applications Ser. Nos. 08/575,106 (now U.S. Pat. No. 5,625,694); 08/574,746 (now U.S. Pat. No. 5,835,604); 08/574,745 (now U.S. Pat. No. 5,742,683); 08/575,110; 08/574,743 (now U.S. Pat. No. 5,793,867): 08/575,112; 08/575,109; 08/575,104 (now U.S. Pat. No. 5,835,689); 08/574,749 (now U.S. Pat. No. 5,590,198) and 08/575,111 now abandoned each filed concurrently herewith, and assigned to the assignee of the present invention.

BACKGROUND OF THE INVENTION

The USPS is presently considering requirements for two metering device types: closed systems and open systems. In a closed system, the system functionality is solely dedicated to metering activity. Examples of closed system metering devices, also referred to as postage evidencing devices (PEDs), include conventional digital and analog postage meters wherein a dedicated printer is securely coupled to a metering or accounting function. In a closed system, since the printer is securely coupled and dedicated to the meter, printing cannot take place without accounting. Furthermore, printing occurs immediately after accounting is concluded.

In an open system, the printer is not dedicated to the metering activity, freeing system functionality for multiple and diverse uses in addition to the metering activity. Examples of open system metering devices include personal computer (PC) based devices with single/multi-tasking operating systems, multi-user applications and digital printers. An open system metering device is a PED with a non-dedicated printer that is not securely coupled to a secure accounting module.

When a PED prints a postage indicia on a mailpiece, the accounting register within the PED must always reflect that the printing has occurred. Postal authorities generally require the accounting information to be stored within the postage meter in a secure manner with security features that prevent unauthorized and unaccounted for postage printing or changes in the amounts of postal funds stored in the meter. In a closed system, the meter and printer are integral units, i.e., interlocked in such a manner as to ensure that the printing of a postage indicia cannot occur without accounting.

Since an open system PED utilizes a printer that is not used exclusively for printing proof of postage payment, additional security measures are required to prevent unauthorized printing evidence of postage payment. Such security measures include cryptographic evidencing of postage payment by PEDs in the open and closed metering systems. The postage value for a mail piece may be encrypted together with other data to generate a digital token. A digital token is encrypted information that authenticates the information imprinted on a mail piece including postage values.

Examples of systems for generating and using digital tokens are described in U.S. Pat. Nos. 4,757,537, 4,831,555, 4,775,246, 4,873,645, and 4,725,718, the entire disclosures of which are hereby incorporated by reference. These systems employ an encryption algorithm to encrypt selected information to generate at least one digital token for each mailpiece. The encryption of the information provides security to prevent altering of the printed information in a manner such that any misuse of the tokens is detectable by appropriate verification procedures.

Typical information which may be encrypted as part of a digital token includes origination postal code, vendor identification, data identifying the PED, piece count, postage amount, date, and, for an open system, destination postal code. These items of information, collectively referred to as Postal Data, when encrypted with a secret key and printed on a mail piece provide a very high level of security which enables the detection of any attempted modification of a postal revenue block or a destination postal code. A postal revenue block is an image printed on a mail piece that includes the digital token used to provide evidence of postage payment. The Postal Data may be printed both in encrypted and unencrypted form in the postal revenue block. Postal Data serves as an input to a Digital Token Transformation which is a cryptographic transformation computation that utilizes a secret key to produce digital tokens. Results of the Digital Token Transformation, i.e., digital tokens, are available only after completion of the Accounting Process.

Digital tokens are utilized in both open and closed metering systems. However, for open metering systems, the non-dedicated printer may be used to print other information in addition to the postal revenue block and may be used in activity other than postage evidencing. In an open system PED, addressee information is included in the Postal Data which is used in the generation of the digital tokens. Such use of the addressee information creates a secure link between the mailpiece and the postal revenue block and allows unambiguous authentication of the mail piece.

Preferably, two Digital Tokens are used to authenticate Postal Data and postage payment. The first is produced by a Digital Token Transformation using a secret key held by the Postal Service and the mailer's PED. The second is produced by a Digital Token Transformation using a secret key held by the PED vendor and the mailer's PED. The fact that two independent entities hold separate verification secrets greatly enhances the security of the system because it provides the Postal Service and the vendor with independent means to authenticate the postal revenue block, and thus, verify postage payment. The use of the second Digital Token Transformation using the vendor's secret key is an optional part of the security which authenticates postage payment by a particular vendor's device. The use of two digital tokens (postal and vendor) is described in pending U.S. patent applications Ser. No. 08133,427 filed Oct. 8, 1993 now U.S. Pat. No. 5,390,251 and Ser. No. 08/242,564, filed May 13, 1994, now U.S. Pat. No. 5,655,023, both assigned to the assignee of the present invention, the entire disclosures of which are hereby incorporated by reference.

SUMMARY OF THE INVENTION

As previously described, an inherent difference between closed metering systems and open metering systems is the printer. The printer in a closed metering system is a secure device that is dedicated for printing evidence of postage. Thus, the printing function in a closed metering system is dependent on the metering function. This contrasts an open metering system printer, which is a non-secure, non-dedicated printer that prints typical PC related documents in addition to printing evidence of postage. Thus, the printing function in an open metering system is independent of the metering function. The present invention provides a process in an open metering system for requesting, calculating, storing and issuing one or more digital tokens that can be used at a later time in the generation of one or more indicia images.

In accordance with the present invention some of the functionality typically performed in the vault of a conventional postage meter has been removed from the vault of a PC-based open metering system and is performed in the PC. It has been discovered that this transfer of functionality from the vault to the PC does not effect the security of the meter because the information being processed includes addressee information. It has also been discovered that in a PC-based open metering system tokens can be issued and then stored for generating and printing an indicia at a later time. It has further been discovered that a token can be reissued if the token is never printed or if a problem occurs preventing a printing of an indicia with the token.

The present invention provides a token generation process for an open metering system, such as a PC-based metering system that comprises a PC, special Windows-based software, a printer and a plug -in peripheral as a vault to store postage funds. The PC meter uses a personal computer and its non-secure and non-dedicated printer to generate digital tokens and later print evidence of postage on envelopes and labels at the same time it prints a recipient address.

The present invention provides a token generation process for an open metering system that includes security that prevents tampering and false evidence of postage payment. The present invention further provides a token generation process that includes the ability to do batch processing of digital tokens.

In accordance with the present invention a method of issuing digital tokens in a open system meter includes the steps of sending a request for digital tokens and predetermined postal information, including addressee information, from a host processor to a vault that is operatively coupled to the host processor; calculating in the vault in response to the request for tokens at least one digital token using the predetermined postal information; debiting postal funds in the vault; issuing the digital token to the host processor; and storing the digital token and the predetermined postal information as a transaction record in the host processor for subsequent generation and printing of an indicia. The method further includes the steps of generating in the host processor an indicia comprising a graphical image of the digital token and the predetermined postal information and storing the indicia in the host processor; and printing the indicia on a mailpiece when requested.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
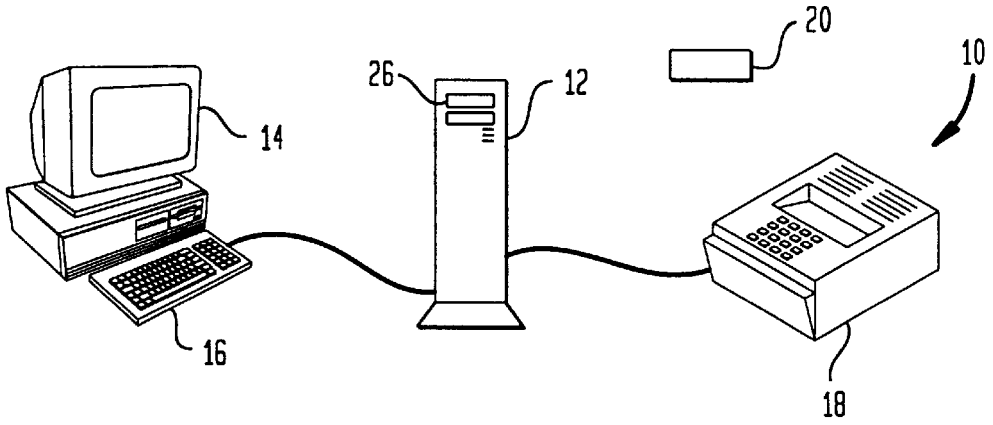
FIG. 1 is a block diagram of a PC-based metering system in which the present invention operates.

In describing the present invention, reference is made to the drawings, wherein there is seen in FIGS. 1–4 an open system PC-based postage meter, also referred to herein as a PC meter system, generally referred to as 10, in which the present invention performs the digital token process. PC meter system 10 includes a conventional personal computer configured to operate as a host to a removable metering device or electronic vault, generally referred to as 20, in which postage funds are stored. PC meter system 10 uses the personal computer and its printer to print postage on envelopes at the same time it prints a recipient's address or to print labels for pre-addressed return envelopes or large mailpieces. It will be understood that although the preferred embodiment of the present invention is described with regard to a postage metering system, the present invention is applicable to any value metering system that includes a transaction evidencing.

As used herein, the term personal computer is used generically and refers to present and future microprocessing systems with at least one processor operatively coupled to user interface means, such as a display and keyboard, and storage media. The personal computer may be a workstation that is accessible by more than one user.

The PC-based postage meter 10 includes a personal computer (PC) 12, a display 14, a keyboard 16, and an non-secured digital printer 18, preferably a laser or ink-jet printer. PC 12 includes a conventional processor 22, such as the 80486 and Pentium processors manufactured by Intel, and conventional hard drive 24, floppy drive(s) 26, and memory 28. Electronic vault 20, which is housed in a removable card, such as PCMCIA card 30, is a secure encryption device for postage funds management, digital token generation and traditional accounting functions. PC meter system 10 may also include an optional modem 29 which is located preferably in PC 12. Modem 29 may be used for communicating with a Postal Service or a postal authenticating vendor for recharging funds (debit or credit). In an alternate embodiment the modem may be located in PCMCIA card 30.

PC meter system 10 further includes a Windows-based PC software module 34 (FIGS. 3 and 4) that is accessible from conventional Windows-based word processing, database and spreadsheet application programs 36. PC software module 34 includes a vault dynamic link library (DLL) 40, a user interface module 42, and a plurality of sub-modules that control the metering functions. DLL module 40 securely communicates with vault 20 and provides an open interface to Microsoft Windows-based application programs 36 through user interface module 42. DLL module 40 also securely stores an indicia image and a copy of the usage of postal funds of the vault. User interface module 42 provides application programs 36 access to an electronic indicia image from DLL module 40 for printing the postal revenue block on a document, such as an envelope or label. User interface module 42 also provides application programs the capability to initiate remote refills and to perform administrative functions.

Thus, PC-based meter system 10 operates as a conventional personal computer with attached printer that becomes a postage meter upon user request. Printer 18 prints all documents normally printed by a personal computer, including printing letters and addressing envelopes, and in accordance with the present invention, prints postage indicia.

Figure 2:
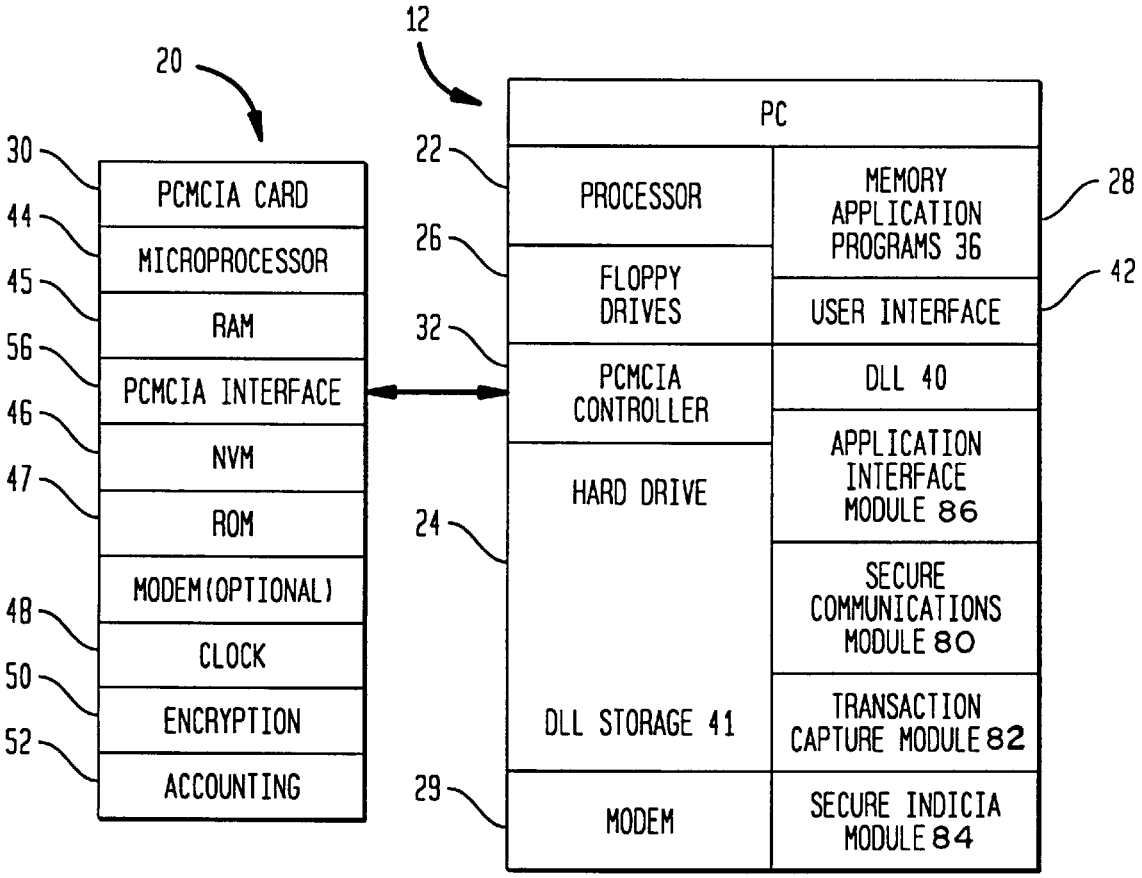
FIG. 2 is a schematic block diagram of the PC-based metering system of FIG. 1 including a removable vault card and a DLL in the PC.
Figure 3:
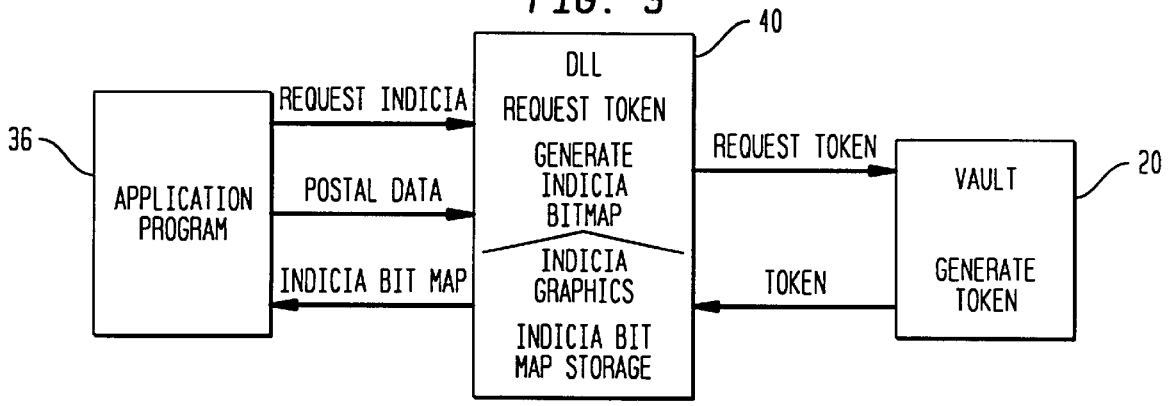
FIG. 3 is a schematic block diagram of the DLL in the PC-based metering system of FIG. 1 including interaction with the vault to issue and store digital tokens.
Figure 4:
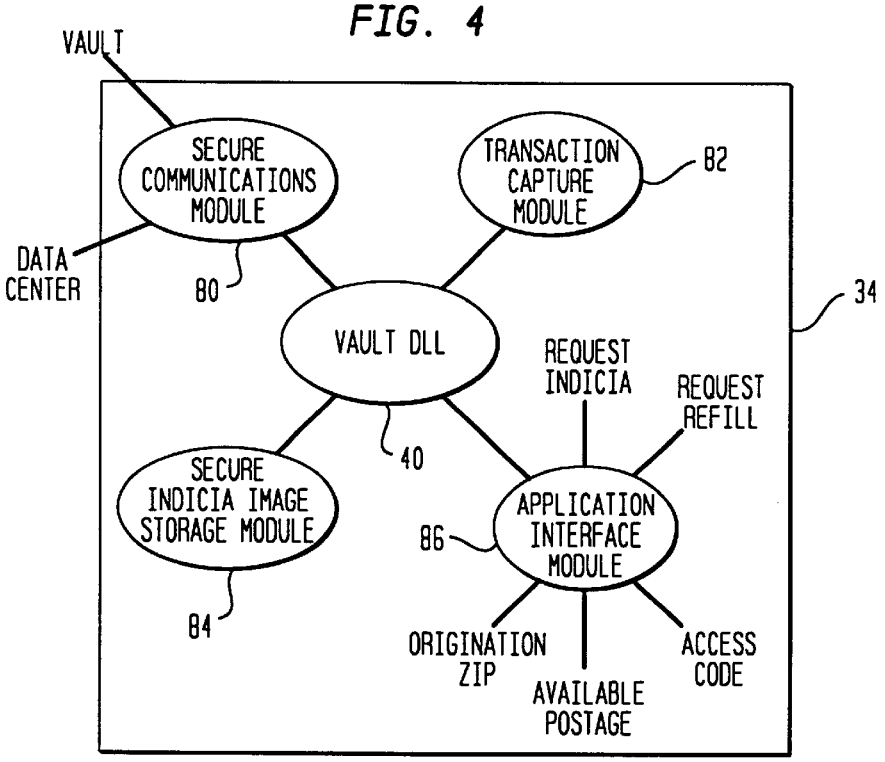
FIG. 4 is a block diagram of the DLL sub-modules in the PC-based metering system of FIG. 1.

The vault is housed in a PCMCIA I/O device, or card, 30 which is accessed through a PCMCIA controller 32 in PC 12. A PCMCIA card is a credit card size peripheral or adapter that conforms to the standard specification of the Personal Computer Memory Card International Association. Referring now to FIGS. 2 and 3, the PCMCIA card 30 includes a microprocessor 44, redundant non-volatile memory (NVM) 46, clock 48, an encryption module 50 and an accounting module 52. The encryption module 50 may implement the NBS Data Encryption Standard (DES) or another suitable encryption scheme. In the preferred embodiment, encryption module 50 is a software module. It will be understood that encryption module 50 could also be a separator device, such as a separate chip connected to microprocessor 44. Accounting module 52 may be EEPROM that incorporates ascending and descending registers as well as postal data, such as origination ZIP Code, vendor identification, data identifying the PC-based postage meter 10, sequential piece count of the postal revenue block generated by the PC-based postage meter 10, postage amount and the date of submission to the Postal Service. As is known, an ascending register in a metering unit records the amount of postage that has been dispensed, i.e., issued by the vault, in all transactions and the descending register records the value, i.e., amount of postage, remaining in the metering unit, which value decreases as postage is issued.

The hardware design of the vault includes an interface 56 that communicates with the host processor 22 through PCMCIA controller 32. Preferably, for added physical security, the components of vault 20 that perform the encryption and store the encryption keys (microprocessor 44, ROM 47 and NVM 46) are packaged in the same integrated circuit device/chip that is manufactured to be tamper proof. Such packaging ensures that the contents of NVM 46 may be read only by the encryption processor and are not accessible outside of the integrated circuit device. Alternatively, the entire card 30 could be manufactured to be tamper proof.

The memory of each NVM 46 is organized into sections. Each section contains historical data of previous transactions by vault 20. Examples of the types of transactions include: postage dispensed, tokens issued, refills, configuration parameters, and postal and vendor inspections. The size of each section depends on the number of transactions recorded and the data length of the type of transaction. Each section in turn is divided into transaction records. Within a section, the length of a transaction record is identical. The structure of a transaction record is such that the vault can check the integrity of data.

The functionality of DLL 40 is a key component of PC-base meter 10. DLL 40 includes both executable code and data storage area 41 that is resident in hard drive 24 of PC 12. In a Windows environment, a vast majority of applications programs 36, such as word processing and spreadsheet programs, communicate with one another using one or more dynamic link libraries. PC-base meter 10 encapsulates all the processes involved in metering, and provides an open interface to vault 20 from all Windows-based applications capable of using a dynamic link library. Any application program 36 can communicate with vault microprocessor 44 in PCMCIA card 30 through DLL 40.

DLL 40 includes the following software sub-modules. Secure communications sub-module 80 controls communications between PC 12 and vault 20. Transaction captures sub-module 82 stores transaction records in PC 12. Secure indicia image creation and storage sub-module 84 generates an indicia bitmap image and stores the image for subsequent printing. Application interface sub-module 86 interfaces with non-metering application programs and issues requests for digital tokens in response to requests for indicia by the non-metering application programs. A more detailed description of PC meter system 10 is provided in related U.S. Pat. Application Ser. No. 08/575,112 filed concurrently herewith and incorporated herein in its entirety by reference.

Since printer 18 is not dedicated to the metering function, issued digital tokens may be requested, calculated and stored in PC 12 for use at a later time when, at a user's discretion, corresponding indicia are generated and printed. Such delayed printing and batch processing is described in more detail in co-pending U.S. Pat. Application Ser. No. 08/575,104 (now U.S. Pat. No. 5,835,689), which is incorporated herein in its entirety by reference.

Digital Token Generation Process

In accordance with the present invention, when a request for digital token is received from PC 12, vault 20 calculates and issues at least one digital token to PC 12 in response to the request. The issued digital token is stored as part of a transaction record in PC 12 for printing at a later time. In the preferred embodiment of the present invention, the transaction record is stored in a hidden file in DLL storage area 41 on hard drive 24. Each transaction record is indexed in the hidden file according to addressee information. It has been discovered that this method of issuing and storing digital tokens provides an additional benefit that one or more digital tokens can be reissued whenever a token has not been printed or if a problem has occurred preventing a printing of an indicia with the token.

By storing digital tokens as part of transaction records in PC 12 the digital tokens can be accessed at a later time for the generation and printing of indicia which is done in PC 12. Furthermore, if a digital token is lost, i.e., not properly printed on a mailpiece, the digital token can be reissued from DLL 40 rather than from vault 20. The storage of transaction records that include vault status at the end of each transaction provides a backup to the vault with regard to accounting information as well as a record of issued tokens. The number of transaction records stored on hard drive 24 may be limited to a predetermined number, preferably including all transactions since the last refill of vault 20.

Figure 5A:
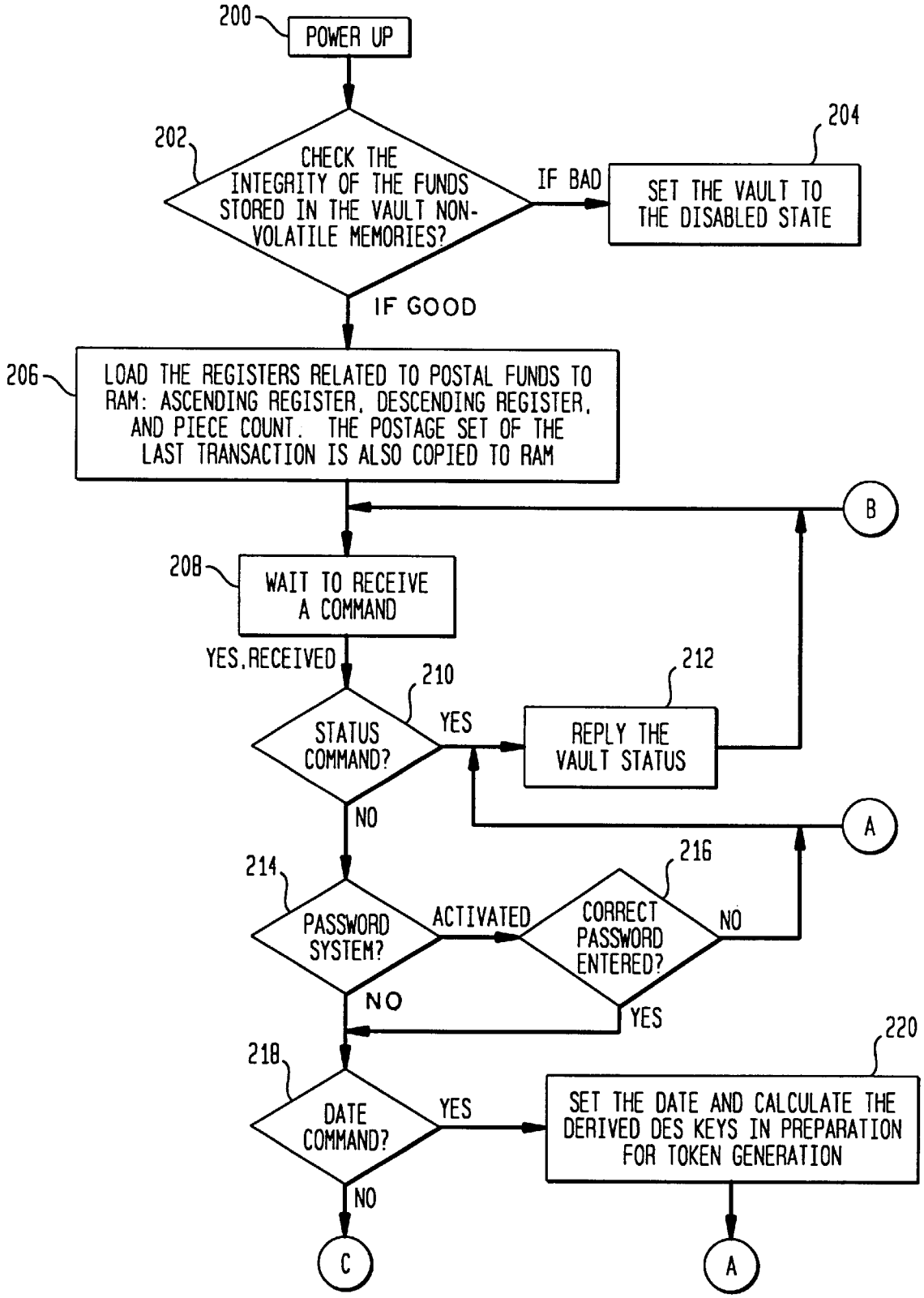
FIGS. 5A, 5B and 5C are a flow chart of a digital token generation process of the present invention.
Figure 5B:
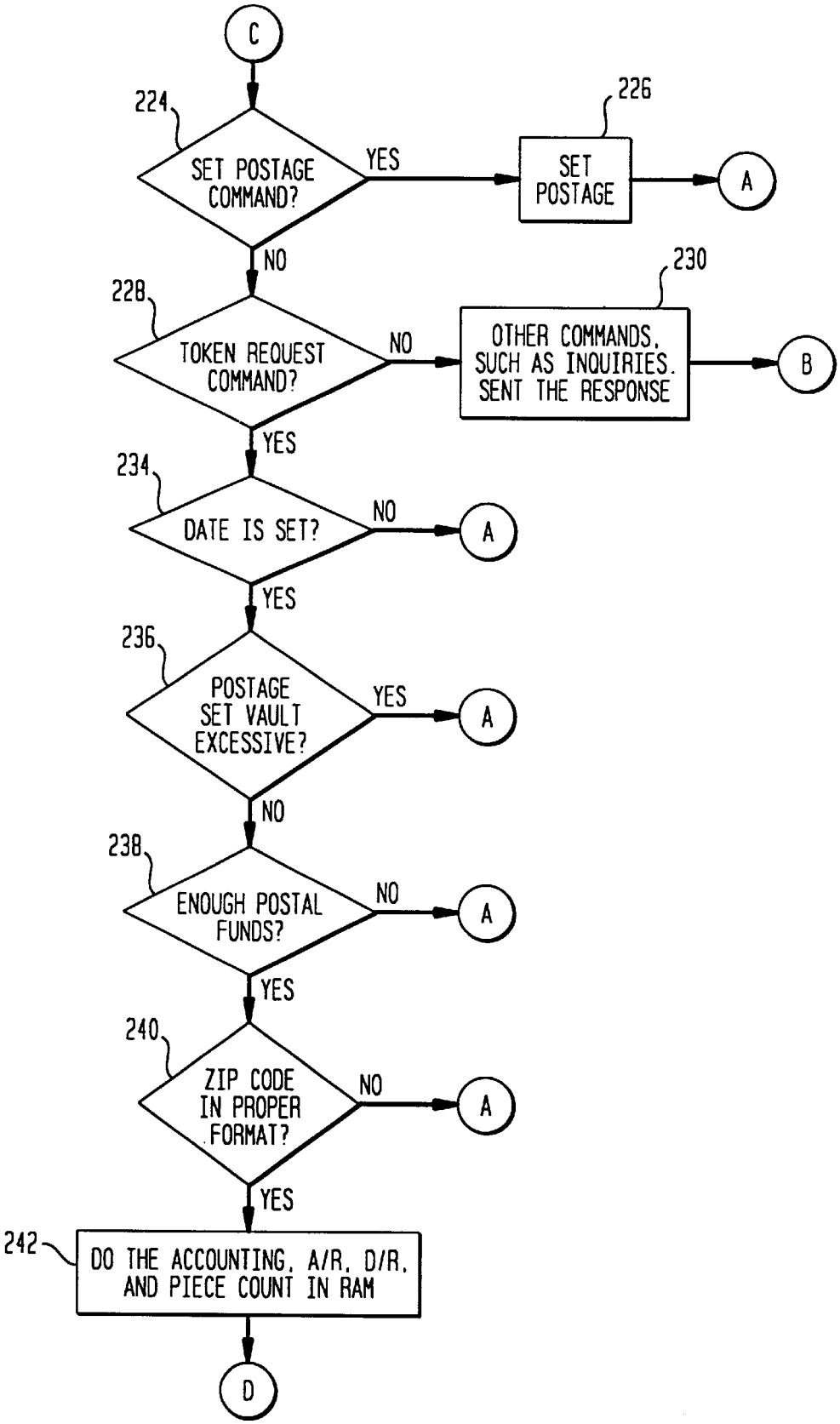
Figure 5C:
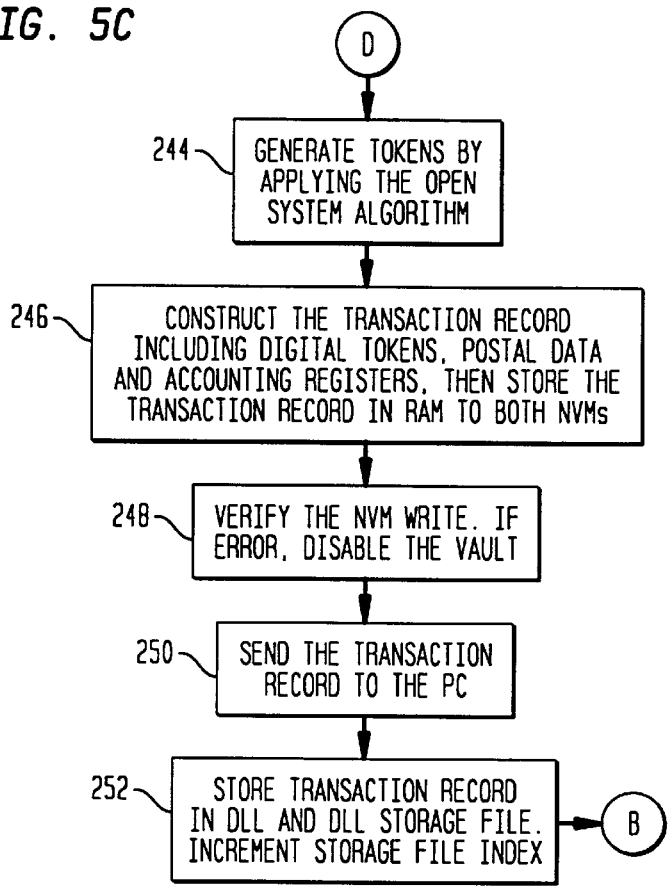

Referring now to FIG. 5A, 5B and 5C, when power is applied, at step 200, to vault 20, i.e. when card 30 is inserted into controller 32, the vault initializes itself. At step 202, vault 20 checks the integrity of the funds stored in the redundant NVM 46. If bad, vault 20 sets itself into a disabled state, at step 204. If the NVM data is correct, then, at step 206, the registers related to postal funds, i.e., the ascending, descending and piece count registers, are loaded to RAM 45 and the most recent transaction record is also loaded into RAM 45. After verifying the data integrity of NVM 46 and copying the most recent records into vault's RAM 45, vault 20 is initialized and thereafter waits for an external command, at step 208.

When a status command is received, at step 210, vault 20 replies to PC 12 with its current status, at step 212, and waits to receive another command at step 208. At step 214, if a password is required to access vault 20 functions, at step 216 an entered password is checked for correctness. If a password is not required, or if a correct password is detected at step 216, the vault checks for a date command. If an incorrect password is entered at step 216, then vault 20 replies to PC 12 with its current status, at step 212, and waits to receive another command at step 208.

When a command to set the date is received, at step 218, for the first time in a particular month, the vault, at step 220, sets the date and derives token generation keys for the month from master keys stored in NVM 46 of the vault and sends a status message to user application program 36 via DLL 40 at step 212 and waits to receive another command at step 208. The vault then enables itself and is ready to receive a token request command. Once the date is set, when another date set command is received in the same month, the vault simply acknowledges the command and sets the date without re-calculating the token generation keys. If a date command is not received at step 218, then at step 224, a postage command is received and a postage value, for example, $0.32, is set at step 226 and sends a status message to user application program 36 via DLL 40 at step 212. If a set postage command is not received at step 224, the vault checks for a token request command.

When a token request command comprising a destination postal code is received by vault 20, at step 228, the vault checks the format of and the range of values in the request at steps 234–240. If the request is improper, vault 20 rejects the request and processes other commands, such as inquiries, at step 230, and waits to receive a command at step 208. If the request is determined to be proper at step 228, vault 20 checks the date in the request, at step 234, and if the date is set the vault then compares, at step 236, the requested postage amount with the two warning values: high value warning and the postage limit amount. If no date is set at step 234, a status message is sent to user application program 36 via DLL 40 at step 212. If the requested postage amount exceeds the warning values at step 236, the request is rejected and a status message is sent to user application program 36 via DLL 40 at step 212. If the requested postage amount does not exceed the warning values at step 236, then vault 20. Compares, at step 238, the requested postage amount with available postal funds in the descending register. If the amount of available postal funds is smaller than the requested amount, the vault rejects the token request command and sends an appropriate message to user application program 36 via DLL 40 at step 212. If the amount of available postal funds is greater than or equal to the requested amount, vault 20 checks the destination information at step 240. If the zip code format is proper, at step 240, then accounting process is initiated at step 242. If not proper, a status message is sent to user application program 36 via DLL 40 at step 212.

Finally, at step 242 vault 20 begins the accounting process to issue a digital token. Vault 20 deducts the requested postage amount from the available postal funds, i.e., adds the amount to the ascending register and subtracts the amount from the descending register, in RAM. At step 244, a digital token is calculated using an open system algorithm, which includes addressee information. At step 246, vault 20 constructs in RAM 45 a transaction record that includes the piece count and the calculated token and stores the transaction record in an indexed file in the redundant NVM 46. In the preferred embodiment, the NVM transaction file is indexed by piece count. After storing to NVM, vault 20 checks, at step 248, the integrity of NVM 46 to confirm that the data is stored correctly. If an error occurs during this process, tokens are not issued and an error message is reported to the host processor in PC 12. If no error occurs, a transmission buffer that consists of the transaction record is assembled and vault 20 transmits, at step 250, the transaction record to DLL 40 in PC 12. At step 252, the transaction record is stored in DLL 40 and in DLL storage area 41. If vault 20 does not receive a positive acknowledgment from PC 12, vault 20 retransmits the message.

Figure 6:
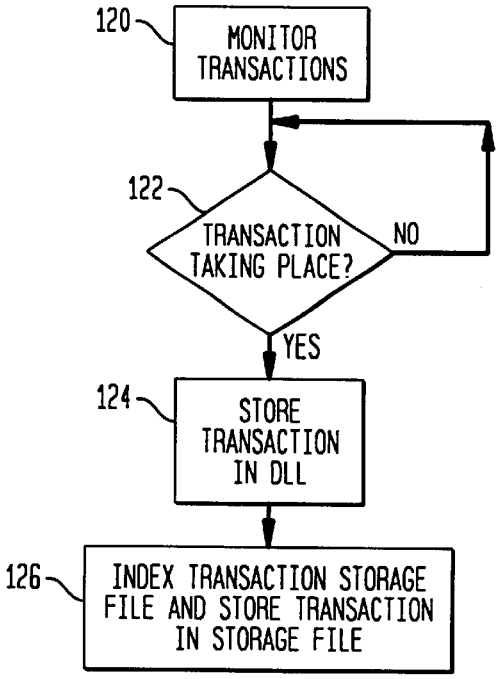
FIG. 6 is a flow chart of the PC storing a transaction record including an issued digital token in the PC-based metering system of FIG. 1.

Conventional postage meters store transactions in the meter. In accordance with the present invention, Transaction Capture sub-module 82 captures each transaction record received from vault 20 and records the transaction record in DLL 40 and in DLL storage area 41 on hard drive 24 for a historical record. If there is ample room on hard drive 24, such transaction captures can be stored for a plurality of different vaults. Referring now to FIG. 6, from the moment that a communication session is established, Transaction Capture sub-module 82 monitors message traffic at step 120. If no transaction is detected at step 122, Transaction Capture sub-module 82 continues to monitor for transactions. When a transaction is detected at step 122, Transaction Capture sub-module 82 selectively captures each transaction record for token generations and refills, and, at step 124, stores such transaction records in DLL 40 in an invisible and write-protected file 83 in DLL storage area 41, the transaction storage file being indexed at step 126 for the next transaction. The information stored for each transaction record includes, for example, vault serial number, date, piece count, postage, postal funds available (descending register), tokens, destination postal code and a block check character. A predetermined number of the most recent records initiated by PC 12 are stored in file 83 which is an historical file indexed according to piece count. File 83 represents the mirror image of vault 20 at the time of the transaction except for the encryption keys and configuration parameters. Storing transaction records on hard drive 24 provides backup capability which is described below. In accordance with the present invention transaction records are maintained for a plurality of issued digital tokens for a predetermined time or count.

Figure 8:
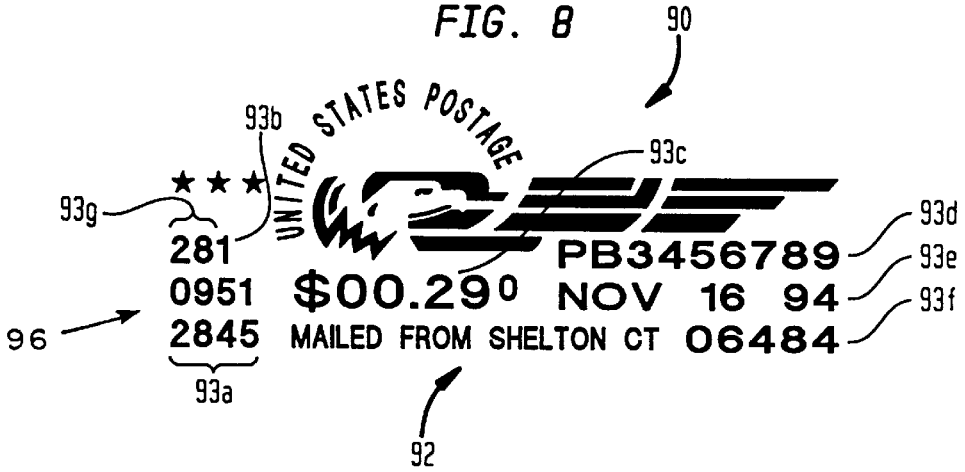
FIG. 8 is an representation of indicia generated and printed by the PC-based metering system of FIG. 1.

In accordance with the present invention, the entire fixed graphics image 90 of the indicia 92, shown in FIG. 8 is stored as compressed data in DLL storage area 41. Postal data information, including piece count 93*a*, vendor ID 93*b*, postage amount 93*c*, serial number 93*d*, date 93*e* and origination ZIP 93*f* and tokens 93*g* are combined with the fixed graphics image 90 by Indicia Image Creation Module 84.

Figure 7:
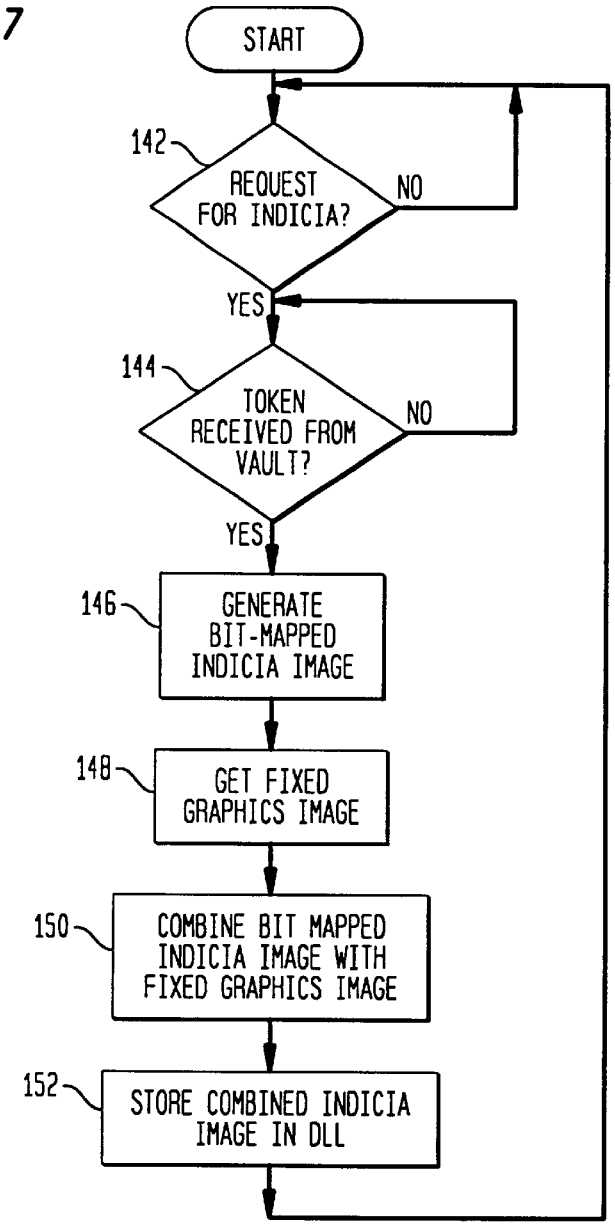
FIG. 7 is a flow chart of the PC generating an indicia image for a digital token in the PC-based metering system of FIG. 1.

Referring now to FIG. 7, when a request for indicia is made from an application program in PC 12 at step 142, Indicia Image Creation Module 84 checks for a digital token from vault 20 at step 144. When Indicia Image Creation Module 84 has not received a request for indicia at step 142 or a digital token at step 144, Indicia Image Creation Module 84 waits for such request or token. When a digital token is received at step 146 Indicia Image Creation Module 84 generates a bit-mapped indicia image 96 by expanding the compressed fixed graphics image data at step 148 and combining at step 150 the indicia's fixed graphics image 90 with some or all of the postal data information and tokens received from vault 20. At step 152, the indicia image is stored in DLL 40 for printing. Sub-module 84 sends to the requesting application program 36 in PC 12 the created bit-mapped indicia image 96 that is ready for printing, and then stores a transaction record comprising the digital tokens and associated postal data in DLL storage area 41. At this time, the indicia can be printed immediately or at a later time.

Thus, the bit-mapped indicia image 96 is stored in DLL 40 which can only be accessed by executable code in DLL 40. Furthermore, only the executable code of DLL 40 can access the fixed graphics image 90 of the indicia to generated bit-mapped indicia image 96. This prevents accidental modification of the indicia because it would be very difficult for a normal user to access, intentionally or otherwise, the fixed graphics image 90 of the indicia and the bit-mapped indicia image 96.

The present invention is suitable for generating a batch of tokens for addresses in a mailing list rather than entering such list of addressees one at a time. The batch of tokens are part of a batch of transaction records, that are indexed in the transaction file in the DLL storage area 41, which are later used to generate indicia images when printing envelopes for the mailing list. Such batch processing would be useful, for example, to production mailers which often have databases of addresses from which to generate mail. These databases are usually pre-processed and sorted to take advantage of postal discounts and recipient profiles for direct marketing opportunities.

In an alternate embodiment, a PC-based open metering system is part of a network with the vault connected to a server PC and the user requesting postage from a user PC. The token generation process would proceed as previously described except that the vault functions, including token generation, would occur in the server PC or the vault card connected thereto. The server PC also stores a record of all transactions for backup and disaster recovery purposes. The user PC would store the transaction records, including issued tokens, on its hard drive and would generate indicia corresponding thereto. This configuration would allow multiple users to send a letter to the same addressee without the token generation being inhibited.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. A method of issuing digital tokens in a open system meter comprising the steps of:

sending a first request for one or more digital tokens and sending predetermined postal information, including addressee information, from a host processor to a vault that is operatively coupled to the host processor;

calculating in the vault in response to the first request at least one digital token using the predetermined postal information;

debiting postal funds in the vault;

issuing the digital token to the host processor;

storing the predetermined postal information as a transaction record in the host processor; and printing at least one indicium containing an image of the digital token.

2. The method of claim 1 wherein the step of storing the predetermined postal information as a transaction record in the host processor includes indexing the transaction record corresponding to piece count.

3. The method of claim 1 comprising the further steps of:

generating in the host processor an indicium comprising a graphical image of the digital token and the predetermined postal information and storing the indicium in the host processor.

4. The method of claim 3 wherein the steps of generating and printing are performed in response to a second request which is separate from the first request.

5. The method of claim 4 wherein a plurality of transactions records are stored on the host processor before a request is made for the generation and printing of digital tokens for the plurality of transaction records.

6. A system for use with a host computer coupled to a secure transaction accounting vault, said system comprising:

a secure communications module for executing communications between the host computer and the secure transaction accounting vault, the communications including sending requests for transactions relating to specified values and recipient information from the host computer to the secure transaction accounting vault and receiving corresponding response messages from the secure transaction accounting vault to the host computer containing digital tokens generated from the specified values and the recipient information;

a transaction capture module for capturing the digital tokens received from the secure transaction accounting vault in a memory device in the host computer; and an application program interface, enabling the system to communicate with an application program running on the host computer, to enable the application program to cause the system to initiate transaction requests.

7. A system as in claim 6, further comprising a secure indicia module for generating a graphic image of an indicia containing each digital token.

8. A system as in claim 6, wherein the transaction capture module stores the graphic image of the indicia in the memory device.

9. A system as in claim 6, further comprising a user interface module.

10. A system as in claim 6, wherein the application program interface comprises a data link library.

11. A system as in claim 6, wherein the transaction capture module comprises instructions in a computer readable medium, said instructions being executable by a programmable processor within the host computer.

12. A system as in claim 6, wherein the secure communications module comprises instructions in a computer readable medium, said instructions being executable by a programmable processor within the host computer.

13. The system as in claim 6 wherein the transaction capture module captures transaction records received from the secure transaction accounting vault, each transaction record including at least one of the digital tokens.

14. The system as in claim 13 wherein the transaction capture module stores the transaction records in the hard drive of the host computer.

* * * * *